US005708311A

United States Patent [19]

Claar et al.

[11] Patent Number: 5,708,311

[45] Date of Patent: Jan. 13, 1998

[54] INTEGRATED ELECTRIC MOTOR DRIVEN IN LINE HYDRAULIC PUMP

[75] Inventors: Leslie M. Claar, Novi; Robert C. Hodges, Troy, both of Mich.

[73] Assignee: Vickers, Inc., Maumee, Ohio

[21] Appl. No.: 682,302

[22] Filed: Jul. 17, 1996

[51] Int. Cl.[6] ..... H02K 21/00

[52] U.S. Cl. ..... 310/90; 310/82; 310/87; 310/63; 417/366; 417/372; 417/371

[58] Field of Search ..... 310/90, 87, 74, 310/63, 82; 417/5, 366, 372, 371

[56] References Cited

U.S. PATENT DOCUMENTS

| | | | |
|---|---|---|---|
| 3,791,766 | 2/1974 | Kikutsugi et al. | 417/363 |
| 4,328,600 | 5/1982 | Bochan | 8/159 |
| 4,529,362 | 7/1985 | Ichiryu et al. | 417/271 |
| 4,729,717 | 3/1988 | Gupta | 417/5 |
| 5,141,402 | 8/1992 | Bloomquist et al. | 417/5 |
| 5,220,225 | 6/1993 | Moon, Jr. | 310/87 |

*Primary Examiner*—Thomas M. Dougherty
*Assistant Examiner*—Timothy A. J. Williams
*Attorney, Agent, or Firm*—Barnes, Kisselle, Raisch, Choate, Whittemore & Hulbert

[57] ABSTRACT

An integrated electric motor-driven in-line hydraulic pump that includes a housing with an internal shaft, and a cylinder block mounted for rotation on the shaft. The rotor of an electric motor has an internally affixed bearing sleeve that is rotatably supported with respect to the shaft surrounding the cylinder block within the housing. Teeth on the sleeve engage splines on the cylinder block for rotatably coupling the rotor to the cylinder block. The stator of the electric motor is affixed within the housing surrounding the rotor. Pistons are operatively coupled to the cylinder block and engage a yoke plate for obtaining positive displacement pumping action upon energization of the motor. Fluid inlet and outlet ports feed hydraulic fluid through the housing to the cylinder block and pistons, and from the cylinder block to the outlet port.

6 Claims, 2 Drawing Sheets

INTEGRATED ELECTRIC MOTOR DRIVEN IN LINE HYDRAULIC PUMP

The present invention is directed to an integrated electric motor-driven in-line hydraulic pump assembly.

BACKGROUND AND SUMMARY OF THE INVENTION

U.S. Pat. No. 4,729,717, assigned to the assignee hereof, discloses an electric-motor in-line hydraulic pump assembly that includes a stationary shaft disposed within a housing. A pair of spaced cylinder blocks are counter-rotatably mounted on the shaft, and arrays of pistons are disposed within each of the cylinder blocks and engage opposite sides of a common yoke plate. Synchronous or asynchronous motor stators are positioned within the housing and surround rotors mounted on the cylinder blocks. A controller energizes the respective motors so that the cylinder blocks rotate in opposite directions and can be held 180° out of phase with each other. A yoke plate control piston and a pressure compensator valve are carried by the housing and coupled to the pump fluid output for maintaining constant output pressure and destroking the pump when fluid output pressure exceeds the desired level.

Although the integrated motor/pump disclosed in the above-noted patent represents a significant advance in previous art and has enjoyed substantial commercial acceptance, further improvements remain desirable. In particular, in assembly of the commercial version of the pump disclosed in the noted patent, all of the parts are especially designed and tooled for this assembly, making the design and tooling expense higher than desired. It is a general object of the present invention to provide an integrated motor/pump of the type disclosed in the noted patent, but in which the primary pump and motor components are the same as or closely similar to standard production parts for separate motor and pump assemblies. Another and related object of the present invention is to provide an integrated motor/pump of the described character that is easier to assemble than similar motor/pump arrangements in the prior art.

An integrated electric motor-driven in-line hydraulic pump in accordance with a presently preferred embodiment of the invention includes a housing with an internal shaft, and a cylinder block mounted for rotation on the shaft. The rotor of an electric motor has an internally affixed bearing sleeve that is rotatably supported with respect to the shaft surrounding the cylinder block within the housing. Teeth on the sleeve engage splines on the cylinder block for rotatably coupling the rotor to the cylinder block. The stator of the electric motor is affixed within the housing surrounding the rotor. Pistons are operatively coupled to the cylinder block and engage a yoke plate for obtaining positive displacement pumping action upon energization of the motor. Fluid inlet and outlet ports feed hydraulic fluid through the housing to the cylinder block and pistons, and from the cylinder block to the outlet port.

The bearing sleeve in the preferred embodiment of the invention takes the form of a hollow body of uniform outer diameter received by press fit within the laminations of the motor rotor. A radially outwardly projecting flange at one end of the sleeve abuts an axial end of the rotor to limit press-fit insertion of the sleeve into the rotor. A radially inwardly projecting shoulder within the sleeve forms a bearing surface that is carried by bearings for rotation with respect to the shaft. The bearing surface is positioned midway between the ends of the sleeve for uniform support of the rotor.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENT

Figure 1:
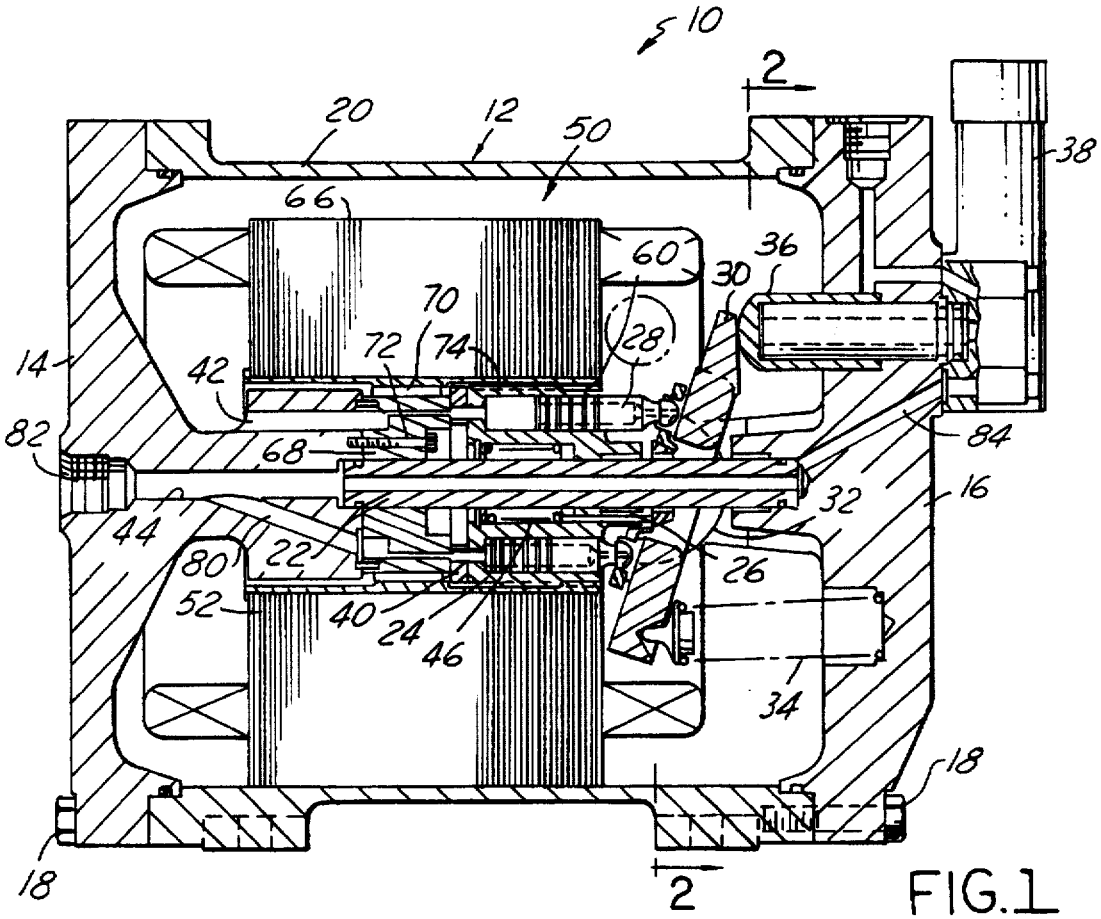
FIG. 1 is a longitudinal view bisecting an electric motor-driven in-line hydraulic pump in accordance with a presently preferred embodiment of the invention.
Figure 2:
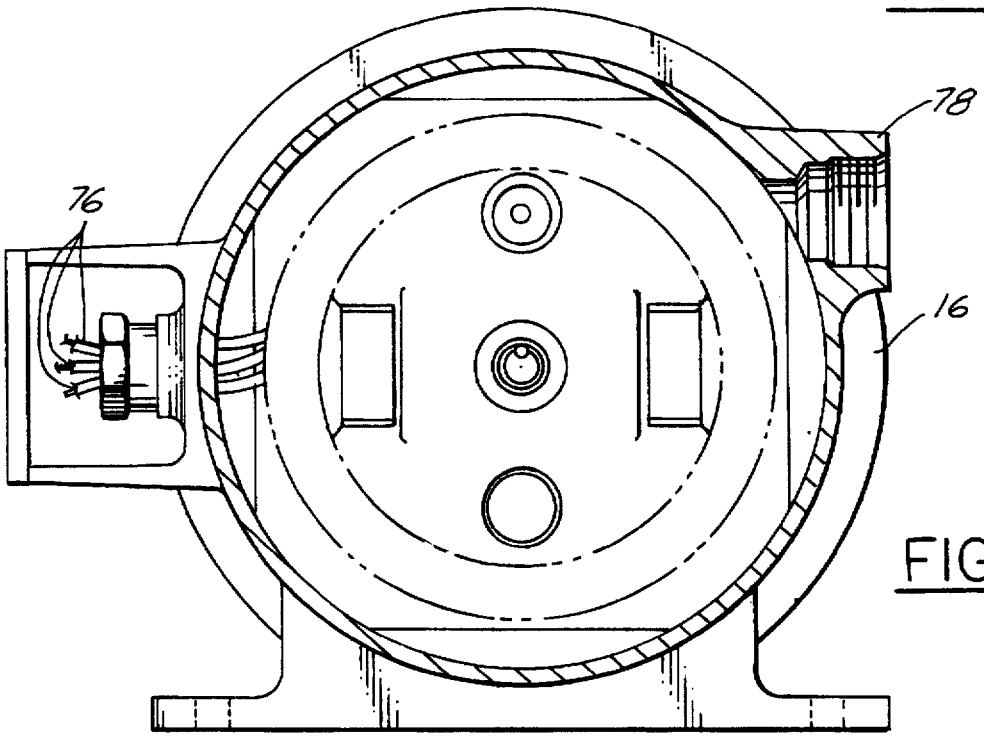
FIG. 2 is an internal elevational view of end bell 16 in the pump of FIG. 1, being taken substantially along the line 2—2 in FIG. 1.

FIGS. 1 and 2 illustrate an integrated electric motor-driven in-line hydraulic pump 10 in accordance with a presently preferred embodiment of the invention as comprising a housing 12 formed by an axially opposed pair of end bells 14,16 fastened by screws 18 to a shell 20 extending therebetween. A shaft 22 is stationarily mounted between end bells 14,16. A cylinder block 24 is rotatably mounted on shaft 22 by a bearing 26. A plurtality of pistons 28 are carried in corresponding bores of cylinder block 24, and engage a yoke plate 30. Yoke plate 30 is mounted on end bell 16 by a pair of cylindrical segment bearings 32, and is engaged on one end by a coil spring 34 for biasing the yoke plate against a diametrically disposed displacement control piston 36. A pressure compensator valve 38 is carried by end bell 16 in fluid communication with piston 36. The bores of cylinder block 24 communicate with a valve plate 40 for porting the cylinders to an inlet passage 42 and an outlet passage 44 in end bell 14. A coil spring 46 urges cylinder block 24 against valve plate 40.

Figure 3:
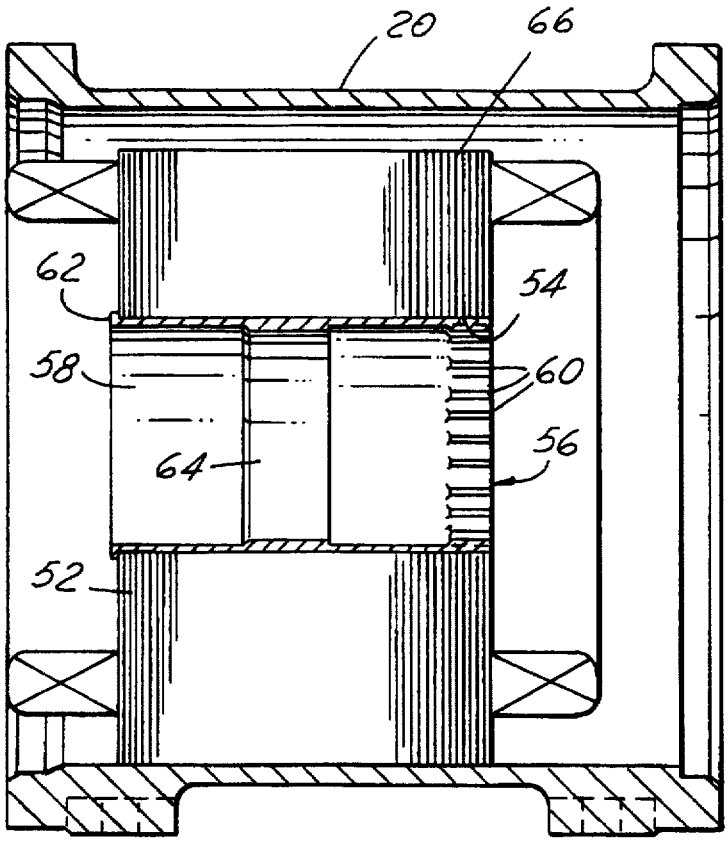
FIG. 3 is a sectional view of a motor and housing sub-assembly in construction of the pump illustrated in FIG. 1.
Figure 4:
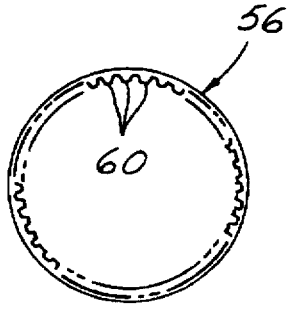
FIG. 4 is an end view of the bearing sleeve illustrated in FIG. 3.
Figure 5:
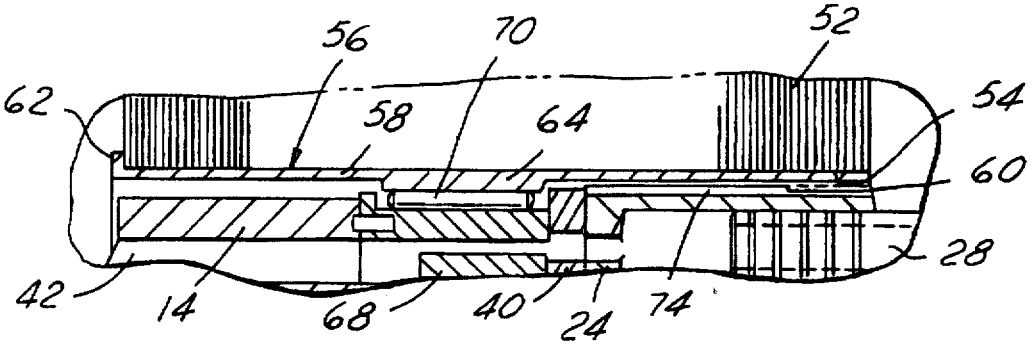
FIG. 5 is a fragmentary sectional view on an enlarged scale of a portion of the pump illustrated in FIG. 1.

An electric motor 50 is mounted within housing 12 and operatively coupled to cylinder block 24. More specifically, motor 50 includes a rotor 52 having a multiplicity of stacked laminations with an internal cylindrical bore 54 (FIGS. 3 and 5). A bearing sleeve 56 is press fitted or otherwise fixedly secured within bore 54 of rotor 52. Bearing sleeve 56 comprises a hollow cylindrical sleeve body 58 of uniform outer diameter secured within rotor 52. A plurality of radially inwardly projecting teeth 60 are disposed at one end of sleeve body 58 in a uniformly angularly spaced circumferential array. A flange 62 projects radially outwardly from the opposing end of sleeve body 58 for limiting press-fit insertion of sleeve 56 into bore 54 of rotor 52, and thereby for accurately positioning sleeve body 58 and teeth 60 within rotor 52. A shoulder 64 projects radially inwardly from sleeve body 58 midway between the axial ends thereof, and termiantes in a radially inwardly facing bearing surface coaxial with sleeve body 58. Motor 50 also includes a stator 66 fixed to housing shell 20 surrounding rotor 52.

Rotor 52 and bearing sleeve 56 are rotatably mounted on a valve block 68 by means of a circumferential array of needle bearings 70 disposed between the radially inwardly facing bearing surface of sleeve shoulder 64 and the radially outwardly oriented surface of the valve block. Valve block 68 is affixed to end bell 14 by an array of screws 72. A circumferential array of axially extending radially outwardly opening splines 74 are disposed on the radially outwardly oriented face of cylinder block 24, and are engaged in assembly by teeth 60 of sleeve 56, as best seen in FIGS. 1 and 5, for rotatably coupling rotor 52 and sleeve 56 to cylinder block 24. Thus, rotor 52, sleeve 56 and cylinder block 24 are freely rotatable with respect to shaft 22 under power by motor stator 66. Stator 66 is powered from an external source of electrical power by means of leads 76 (FIG. 2) that extend through a sealed opening in shell 20 of housing 12.

Thus, when motor 50 is energized, cylinder block 24 is rotated about shaft 22 causing positive displacement pumping action by pistons 28 within the cylinder block. Hydraulic fluid is drawn through inlet port 78 (FIG. 2) in shell 20 of housing 12 into the interior of the housing surrounding the motor and stator components. This inlet fluid is then drawn through passage 42 of end bell 14, through valve block 68 and valve plate 40 into the cylinders of cylinder block 24. Fluid under pressure is delivered from cylinder block 24 through a passage 80 in valve block 68 and end bell 14 to outlet passage 44 and outlet port 82 in end bell 14. Fluid at outlet pressure is also fed through the hollow interior of shaft 22 and a passage 84 in end bell 16 to pressure compensation valve 38 and displacement control piston 36 for destroking the pump in the event of excess fluid outlet pressure.

It will thus be appreciated in accordance with the present invention that the integrated motor/pump herein disclosed satisfies the objects and aims previously set forth. In particular, the motor/pump is specifically designed to accommodate use of standard motor and pump components with little or no modification in either the components or the manufacturing tooling. That is, sleeve 56 that couples motor rotor 52 to cylinder block 24 can be varied in thickness to accommodate motor and pump components of different sizes. Sleeve 56 is a part specific to this design, and splines 74 are formed in cylinder block 24, but otherwise the motor and pump components are of standard design.

We claim:

1. An integrated electric motor-driven in-line hydraulic pump comprising:

a housing with a shaft carried within said housing, a cylinder block mounted for rotation on said shaft and having splines extending from said cylinder block, an electric motor rotor having a bearing sleeve internally affixed to said rotor with means on said sleeve for rotatably supporting said rotor with respect to said shaft surrounding said cylinder block and teeth on said sleeve engaging said splines for rotatably coupling said rotor to said cylinder block, an electric motor stator affixed within said housing surrounding said rotor, piston means operatively coupled to said cylinder block for obtaining positive displacement pumping action upon energization of said stator, and fluid inlet and outlet means for feeding hydraulic fluid from said inlet means through said housing to said cylinder block and piston means, and thence to said outlet means.

2. The pump set forth in claim 1 wherein said bearing sleeve includes a hollow body of uniform outer diameter received by press fit within said electric motor rotor.

3. The pump set forth in claim 2 wherein said bearing sleeve further includes a radially outwardly projecting end flange that abuts an axial end of said rotor.

4. The pump set forth in claim 2 wherein said bearing sleeve further includes means extending radially inwardly from said body to a cylindrical bearing surface within said sleeve, said pump further comprising bearing means rotatably supporting said bearing surface with respect to said stationary shaft.

5. The pump set forth in claim 4 wherein said bearing surface is disposed mid-way of said sleeve axially of said shaft.

6. The pump set forth in claim 2 wherein said splines are disposed on a radially outwardly facing surface of said cylinder block, and said teeth extend radially inwardly from said sleeve.

* * * * *